US005485186A

United States Patent [19]

Ishinaga et al.

[11] Patent Number: 5,485,186

[45] Date of Patent: Jan. 16, 1996

[54] INK JET RECORDING APPARATUS WITH EFFICIENT AND RELIABLE INK SUPPLY

[75] Inventors: Hiroyuki Ishinaga, Tokyo; Hiroshi Sugitani, Machida; Kazuaki Masuda, Kawasaki; Masami Kasamoto, Ayase; Seiji Suzuki, Kawasaki; Toshio Kashino, Chigasaki; Jun Kawai, Yokohama; Takeshi Okazaki, Sagamihara; Teruo Arashima, Kawasaki; Yuji Kamiyama, Fujisawa, all of Japan

[73] Assignee: Canon Kabushiki Kaisha, Tokyo, Japan

[21] Appl. No.: 136,106

[22] Filed: Oct. 14, 1993

[30] Foreign Application Priority Data

Oct. 15, 1992 [JP] Japan ..... 4-277180

[51] Int. Cl.[6] ..... B41J 2/05

[52] U.S. Cl. ..... 347/65

[58] Field of Search ..... 347/65, 63, 57, 347/56, 87, 86

[56] References Cited

U.S. PATENT DOCUMENTS

| | | | |
|---|---|---|---|
| 4,313,124 | 1/1982 | Hara | 347/57 |
| 4,334,234 | 6/1982 | Shirato | 347/65 |
| 4,338,611 | 7/1982 | Eida et al. | 347/63 |
| 4,345,262 | 8/1982 | Shirato et al. | 347/57 |
| 4,459,600 | 7/1984 | Sato et al. | 347/56 |
| 4,463,359 | 7/1984 | Ayata et al. | 347/56 |
| 4,558,333 | 12/1985 | Sugitani et al. | 347/65 |
| 4,723,129 | 2/1988 | Endo et al. | 347/56 |
| 4,723,136 | 2/1988 | Suzumura | 347/65 |
| 4,740,796 | 4/1988 | Endo et al. | 347/56 |
| 4,752,787 | 6/1988 | Matsumoto et al. | 347/65 |
| 4,897,674 | 1/1990 | Hirasawa | 347/65 |
| 5,148,192 | 9/1992 | Izumida | 347/56 |

FOREIGN PATENT DOCUMENTS

| | | |
|---|---|---|
| 0439633 | 8/1991 | European Pat. Off. . |
| 0461939 | 12/1991 | European Pat. Off. . |
| 0504879 | 9/1992 | European Pat. Off. . |
| 54-56847 | 5/1979 | Japan . |
| 59-123670 | 7/1984 | Japan . |
| 59-138461 | 8/1984 | Japan . |
| 60-71260 | 4/1985 | Japan . |
| 4-250050 | 9/1992 | Japan . |

*Primary Examiner*—Joseph W. Hartary

*Attorney, Agent, or Firm*—Fitzpatrick, Cella, Harper & Scinto

[57] ABSTRACT

An ink jet recording apparatus includes an orifice for ejecting ink; a heater for generating thermal energy to produce a bubble to eject the ink; an ink passage for supplying ink to the orifice, the ink passage being provided with the heater; an ink container for containing ink to be supplied to the ink passage, the ink container retaining the ink, using capillary force; wherein the following is satisfied:

$$V_{OH}>[(R'+P)/(F'+R'+P)\times(F+R)/R+1\ ]Vd$$

where $V_{OH}$ is a volume of the ink passage from the orifice to an edge of the heater adjacent the orifice, Vd is a volume of ink ejected from the orifice, F is a flow resistance from a center of the heater to the orifice; R is a flow resistance from a center of the heater to the ink container; F' is a flow resistance from a maximum bubble produced on the heater to the orifice; R' is a flow resistance from a maximum bubble produced on the heater to the ink container, and P is a flow resistance of the ink container.

2 Claims, 13 Drawing Sheets

M

K

INK JET RECORDING APPARATUS WITH EFFICIENT AND RELIABLE INK SUPPLY

FIELD OF THE INVENTION AND RELATED ART

The present invention relates to an ink jet recording apparatus usable as an output of information processing apparatus or an ink jet printer integral with the information processing apparatus, more particularly a personal computer, a word processor, a copying machine or a facsimile machine. Among them, the present invention is particularly relates to an ink jet recording apparatus using an electrothermal transducer as energy generating element for generating energy to eject ink, Wherein the ink is ejected in accordance with the image information signal.

Such an ink jet recording apparatus is disclosed in U.S. Pat. No. 4,723,129.

As one of the factors influential to the recorded or printed image quality in such a recording apparatus, there is a volume or amount or a direction of ink droplet ejected from the recording head. One of the factors determining the recording speed is a ejection frequency of the recording head.

Thus, the ejection property of the recording head is one of the important factors influential to the specifications of the recording apparatus. Heretofore, when the recording head is designed in consideration of the ejection properties, the structures of the ejection outlet and the ink passage communicating with the ejection outlet of the recording head, are designed in combination or independently from each other in accordance with the desired ejection property.

In U.S. Pat. No. 4,338,611, a minimum distance b from an ink supply port to a heat generating element and a minimum distance a between an ink ejection outlet and the heat generating element, satisfy $1/100 \leqq a/b \leqq 1/2$. In this patent, it is described that by doing so the ejecting direction is stabilized, the response frequency (number of droplets ejected per unit time) is increased, and droplet satellite can be prevented. Clearly, this patent teaches away $a \geqq b$.

In U.S. Pat. No. 4,723,136, there is disclosed a recording head having a flow resistance-element between a heat generating element and an ink supply port for an ink passage.

U.S. Pat. No. 4,897,674 discloses that a distance L1 and a distance L2 from the ejection outlet to an end of the heat generating element closer to the ink supply port, satisfy $L2 \leqq L1 \leqq 5L2$. This patent further discloses that a partial wall is provided in a common liquid chamber for the purpose of stabilizing the ejection speed, and that the cross-sectional area reduces toward the ejection outlet. The change of the cross-sectional area is also disclosed in U.S. Pat. No. 4,752,787.

These patents are directed to the structure of the recording head only. As another proposal, there is a Japanese Laid-Open Patent Application No. 250050/1992, which discloses a recording apparatus using a recording head provided with heat generating elements for discrete liquid passages in which the heat generating elements are not simultaneously actuated, and in which the distance between the ejection outlet and the heat generating element 1a and the distance between the ink supply port and the heat generating element 1b satisfy 1a>1b, and in which 1b is not less than 90 μn and not more than 130 μm, and 1a is not more than 110 μm, by which the responsive frequency is increased.

However, they did not note an influence the ink container to the recording head. The present invention has been made in consideration of this influence.

In the case that an ink supply system to the ink supply port has an ink retaining force resulting from capillary force, as in the case that the ink supply system for the recording head is in the form of an ink container retaining the ink using sponge or the like (as in the case of ink jet cartridge) or in the case that the distance between the ink container and the ink passage is very long and narrow, initial several ink ejections in the case of continuous ejection, exhibits instable volumes of the ink droplet, with the result of blurred print.

With such an ink supply system, if the ink is continuously ejected through a great number of orifices, the resistance against flow is large due to the fluid inertia until the stabilized ink flow is established, and therefore, the vacuum in the ink passage is high.

Referring to FIG. 7, this will be described. Before start of ejection ($0$–$t_1$), the vacuum in the ink passage 1 is $x_1$. Upon start of the ejection ($t_1$), the vacuum increases to $x_3$ instantaneously due to the fluid inertia (fluid length/cross-sectional area), and the vacuum gradually decreases in a region y. In a region z after $t_2$, the constant vacuum is established. The increase of the vacuum upon the start of ejection results in blurness of the print.

Referring to FIG. 8, there is shown an equivalent electric circuit corresponding to the ink passage and the ink supply system. Since a constant volume of the ink is ejected per unit time from the orifice 5, and therefore, the ink flow is equivalent to a constant current i. The ink supply system 11 has a resistance R corresponding to the flow resistance and a reactance L equivalent to the fluid inertia mass. Upon an actuation of ink ejection switch 12, the current i starts to flow. In the rising region, the electric current does not easily flow due to the reactance L, and therefore, a high voltage (vacuum) is produced in the ink passage 1 (constant voltage source). It gradually decreases to a constant voltage. It will be understood the high vacuum is produced in the ink passage 1 until the constant region z is reached from the start of the ejection. This increases the time required for refilling the ink.

The conventional design of the recording head is directed to improvement of the property in the z region.

SUMMARY OF THE INVENTION

Accordingly, it is a principal object of the present invention to provide an ink jet cartridge, an ink jet recording apparatus, and ink ejecting method in which the blurness of the print upon the ejection start can be effectively prevented, thus stabilizing the ink ejection.

According to an aspect of the present invention, there is provided an ink jet recording apparatus comprising: an orifice for ejecting ink: a heater for generating thermal energy to produce a bubble to eject the ink; an ink passage for supplying ink to the orifice, the ink passage being provided with the heater; an ink container for containing ink to be supplied to the ink passage, the ink container retaining the ink, using capillary force; wherein the following is satisfied:

$$V_{OH} > V'Me + Vd$$

where $V_{OH}$ is a volume of the ink passage from the orifice to an edge of the heater adjacent the orifice; V'Me is a volume of a meniscus retraction at an initial ink ejection; and Vd is a volume of ejected ink.

According to another aspect of the present invention, there is provided an ink jet recording apparatus comprising an orifice for ejecting ink, a heater for generating thermal energy to produce a bubble to eject the ink, an ink passage for supplying ink to the orifice, the ink passage being provided with the heater and an ink container for containing ink to be supplied to the ink passage, the ink container retaining the ink, using capillary force. The following is satisfied:

$$V_{OH}>[(R'+P)/(F'+R'+P)\times(F+R)/R+1]Vd,$$

where $V_{OH}$ is a volume of the ink passage from the orifice to an edge of the heater adjacent the orifice, Vd is a volume of ink ejected from the orifice, F is a flow resistance from a center of the heater to the orifice, R is a flow resistance from a center of the heater to the ink container, F' is a flow resistance from a maximum bubble produced on the heater to the orifice, R' is a flow resistance from a maximum bubble produced on the heater to the ink container, and P is a flow resistance of the ink container.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

First, the description will be made as to the mechanism of the occurrence of the blurness of the print upon the start of ejection.

Figure 1:
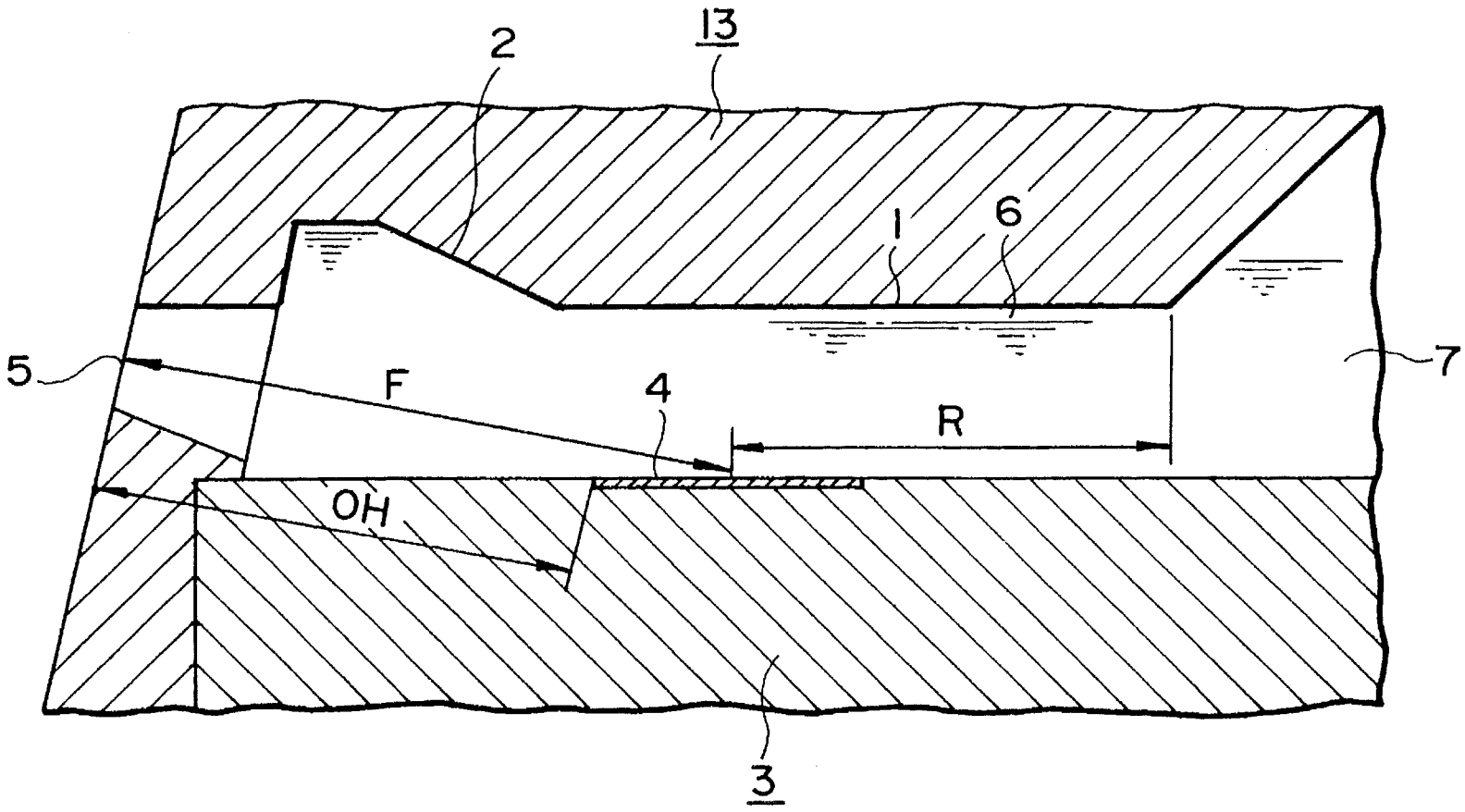
FIG. 1 is a longitudinal sectional view of an ink passage of a recording head according to an embodiment of the present invention.

FIG. 1 is a sectional view of an ink passage of a recording head according to an embodiment of the present invention. A top plate 13 provided with grooves constituting the ink passages and a heater board 3 are connected to constitute ink passages 1. The ink passages 1 are filled with the ink 6 by communication with a common liquid chamber 7. The heater board 3 is provided with heaters 4 for producing thermal energy for ejecting the ink. They heat the ink 6 in the ink passage 1 to produce bubbles. When the apparatus is not operated, the ink 6 forms a meniscus at a constant position by balance between a vacuum in the ink container (not shown) and the capillary force (flow resistance) in the ink passage 1. By application of driving electric energy to the heater 4, the ink 6 in the ink passage in front of the heater 4 is ejected in the form of a droplet by the volume expansion of the bubble formed by the heater 4. Thereafter, the ink 6 remaining in the ink passage in front of the heater 4 tends to return to the heater portion with the result of retraction of the meniscus. If an ink container has strong capillary force by an ink absorbing material or the like, a high vacuum is produced in the ink passage due to the fluid inertia of the ink, as described hereinbefore. This retards the ink supply from the ink container. As a result, the meniscus in the ink passage 1 retracts to a position quite close to the heater 4. The next ink ejection may occur before the meniscus returns to the original position completely. If the meniscus is retracted too much, if the volume of the ink remaining in the ink passage in front of the heater 4 is smaller than the normal ejection volume, the pressure energy due to the volume expansion of the bubble is too large for the smaller volume of the ink, and therefore, the droplet tends to splash upon the ejection. This is a cause of the blurness in the print. Generally, the print blurness occurs also when the ink container does not have strong capillary force. This will be described.

In FIG. 1, an ink flow resistance F at the part downstream of the center of the heater 4 is represented as $F(m^{-1})$= [heater-orifice distance (the distance between the center of the heater and the orifice)]/[cross-sectional area of the ink passage]. An ink flow resistance R of a part upstream of the center of the heater 4 is represented as $R(m^{-1})$= [heater-chamber distance (the distance between the center of the heater to the liquid chamber)]/[cross-sectional area of the ink passage].

Figure 2:
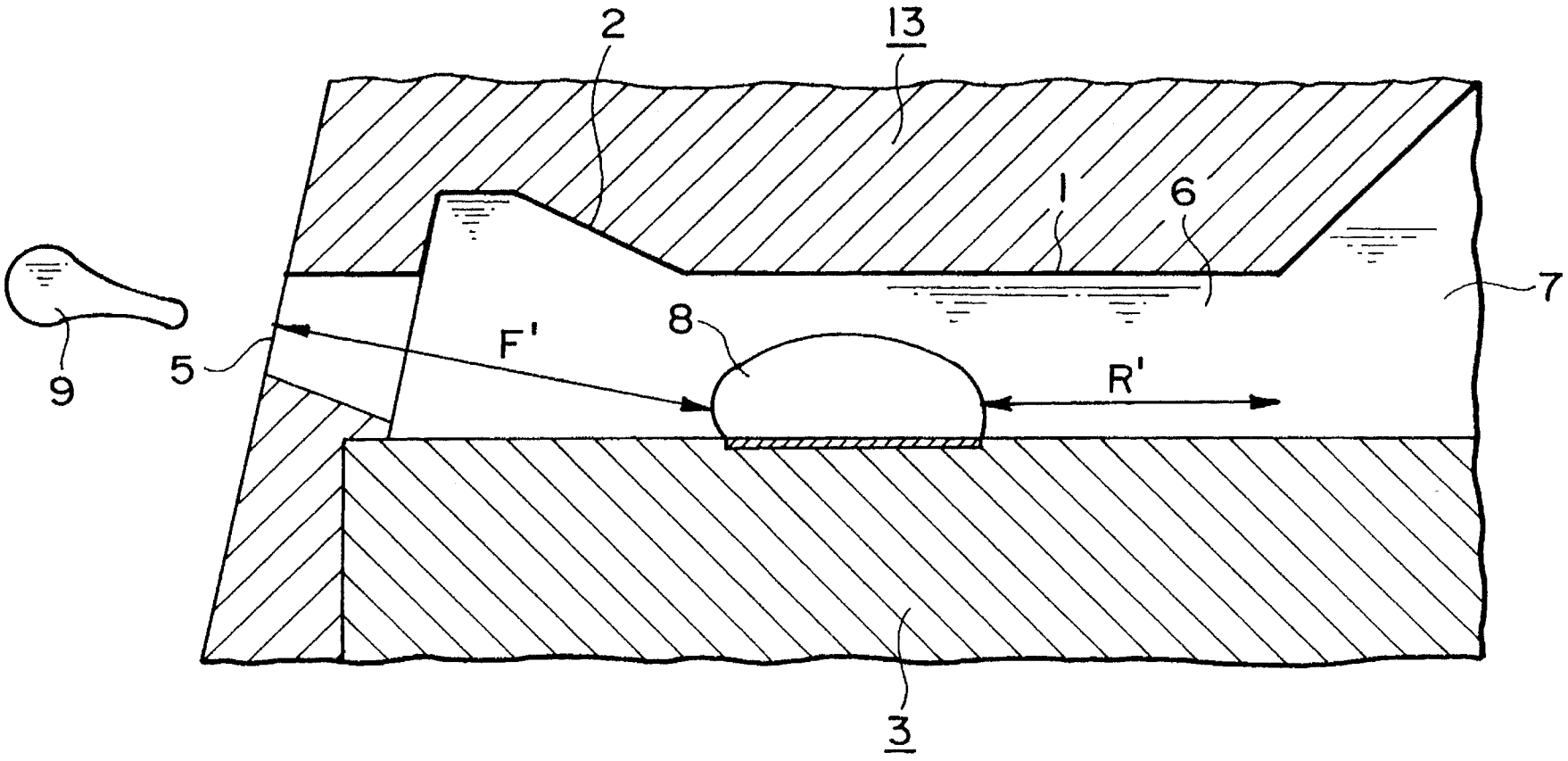
FIG. 2 is a longitudinal sectional view of the same.

The consideration will be made as to the case in which the ink 6 is heated by the heater to create a bubble 8 as shown in FIG. 2 to eject the ink droplet 9 through the orifice 5. At this time, a volume Vd of the ink droplet is substantially expressed by the following equation.

$$Vd=R(F+R)\times Vb \quad (1)$$

where Vb is a volume of the bubble 8.

Figure 3:
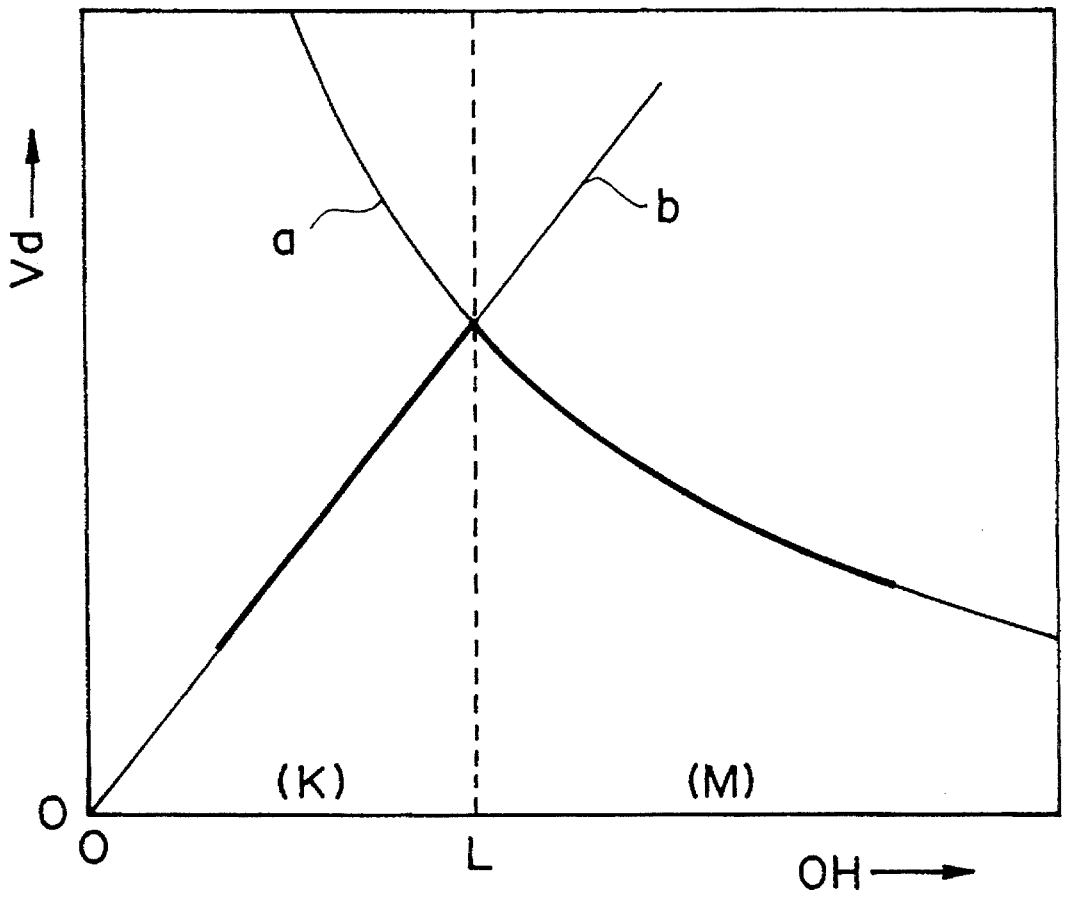
FIG. 3 is a graph showing a relationship between an orifice-heater distance and a volume of an ink droplet, in the embodiment of the present invention.

From the equation (1), it will be understood that with the increase of F, that is, with the increase of the distance OH (FIG. 1) between a front edge of the heater 4 and the orifice 5, the ejection volume Vd decreases. This is shown in FIG. 3 by a curve a.

It will be understood that with the decrease of the distance OH, the ejection volume Vd increases. However, in the case of the ink ejection using the bubble, the bubble expansion period is so short that the ejection volume Vd involves an upper limit. More particularly, the volume ejected during time period t is:

$$V=S_0\times v\times t=S_0\times \underline{l}/t_1\times t_2 \quad (2)$$

where v is a speed of the ink ejected through the orifice 5, $S_0$ is a cross-sectional area of the orifice; and $\underline{l}$ is an amount of distance through which the ink moves during $t_1$.

When times $t_1$ and $t_2$ approach to 0, then, $$\lim_{t_1=t_2\to 0} V=S_0\times \underline{l} \quad (3)$$

The maximum volume Vdlim which is the maximum volume capable of being ejected for the very short period of several μsec for which the bubble expands, is $S_0\underline{l}$, that is, $$Vdlim=S_0\times OH \quad (4)$$

The equation (4) is plotted on a graph of FIG. 3 as a curve b. As will be understood from this graph, Vdlim is proportional to the distance OH, and the constant of proportion is the area $S_0$ of the orifice 5.

In this Figure, the two curves a and b intersect with each other at a distance L. With the boundary of OH=L, K zone is defined by Vd>Vdlim, and M zone is defined by Vd<Vdlim. The recording head of this embodiment falls in M zone.

Referring to FIG. 4, the process of bubble creation, bubble collapse and restoration of the meniscus will be described for the respective zones.

Figure 4A:
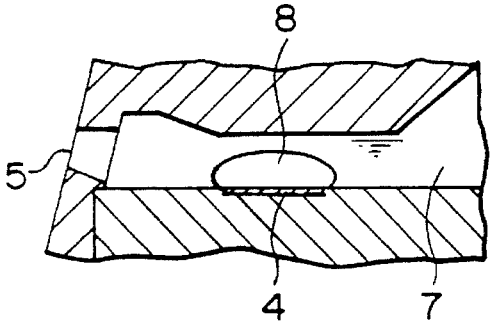
FIGS. 4(A)–4(H) are sectional views of an ink passage illustrating ink refilling behavior upon the ink ejection, in the embodiment of the present invention and prior art.
Figure 4E:
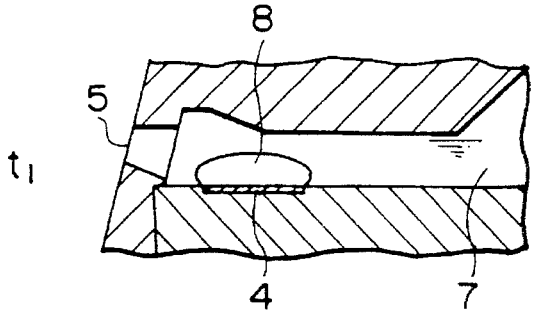
Figure 4B:
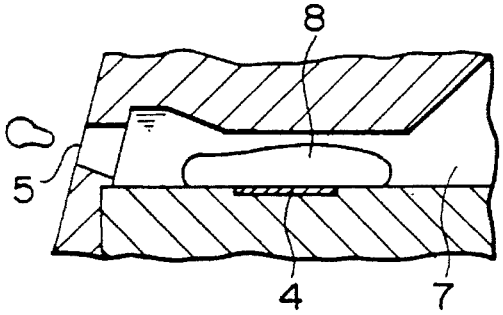
Figure 4F:
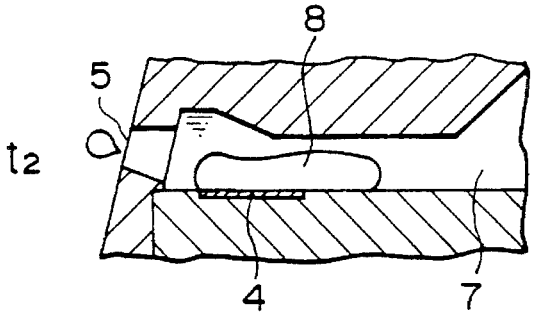
Figure 4C:
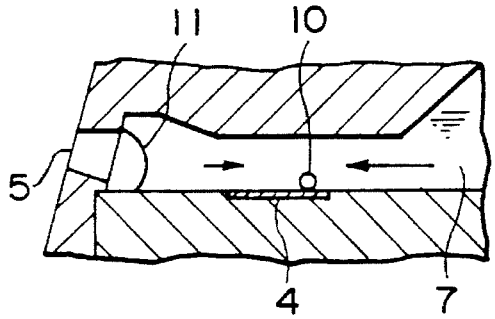
Figure 4G:
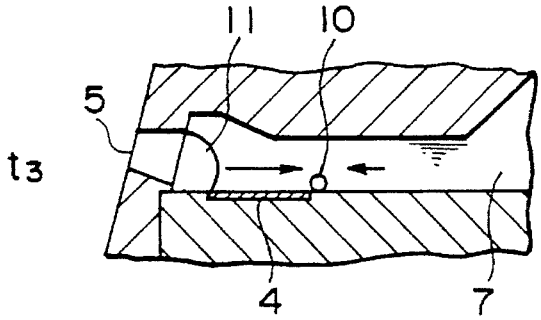
Figure 4D:
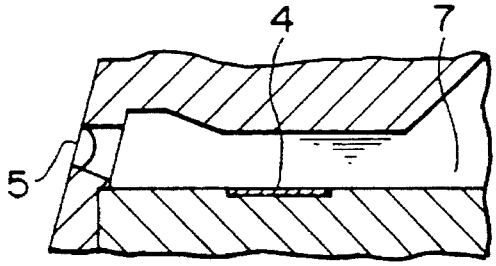
Figure 4H:
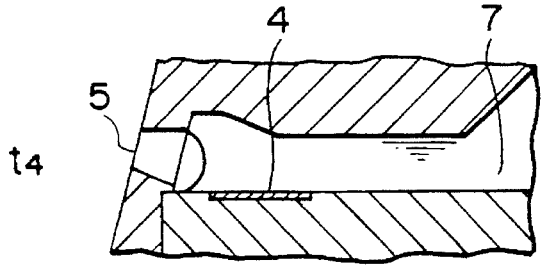

At time $t_1$, the bubble 8 is created by the actuation of the heater 4 (FIGS. 4(A) and 4(D)). FIGS. 4(B) and 4(E) show the state at time $t_2$. At this time, if the heater 4 is in the M zone, the bubble 8 is located substantially at the center of the heater 4. If the heater 4 is in the K zone, the ink flow is limited in the orifice 5 side, and therefore, the bubble 8 is deviated toward the liquid chamber 7. As a result, if the heater 4 is in the K zone, the ink is moved backwardly with the result of delayed refilling. The volume of the backward motion is:

$$Vd-Vdlim \quad (5)$$

The refilling action is delayed corresponding to this volume.

As shown in FIG. 4(C) and 4(F), the bubble 8 collapses at time $t_3$. The point of time of collapse 10 in the case of M zone, is slightly behind the center of the heater 4. In the case of K zone, it is further behind.

Referring to FIG. 4(C) and 4(F) , the mechanics of the bubble collapse will be described.

A meniscus (11) retraction volume (no-ink volume) VMe is:

$$\begin{aligned} VMe &= R'/(F'+R')\times Vb \\ &= R'/(F'+R')\times (F+R)/R\times Vd \end{aligned} \quad (6)$$

where Vb is a volume of the bubble 8, F' is a flow resistance downstream of the bubble 8 (FIG. 2), and R' is a flow resistance upstream of the bubble 8 (FIG. 2).

The motion of the ink from the orifice 5 side and the liquid chamber 7 side to replace the bubble which is collapsing, is considered. When F' is large as in M region (distance OH is relatively larger), the resistance at the orifice 5 side is large, and the distance of ink movement from the liquid chamber 7 is relatively large. Therefore, the collapse position 10 is not shifted behind. This means that the meniscus retraction (VMe) is small. This is advantageous from the standpoint of the refilling action.

On the other hand, if F' is small as in K region (distance OH is small), tile distance of ink movement from the meniscus 9 side is larger by the volume Vd–Vdlim, and therefore, the collapse position 10 is shifted behind. As a result, the meniscus retraction is larger relative to the ejection volume. In addition, the initial ink refilling speed at the time of the start of the refilling, decreases, conversely to the case of M region, and therefore, the refilling period is very long.

Figure 5:
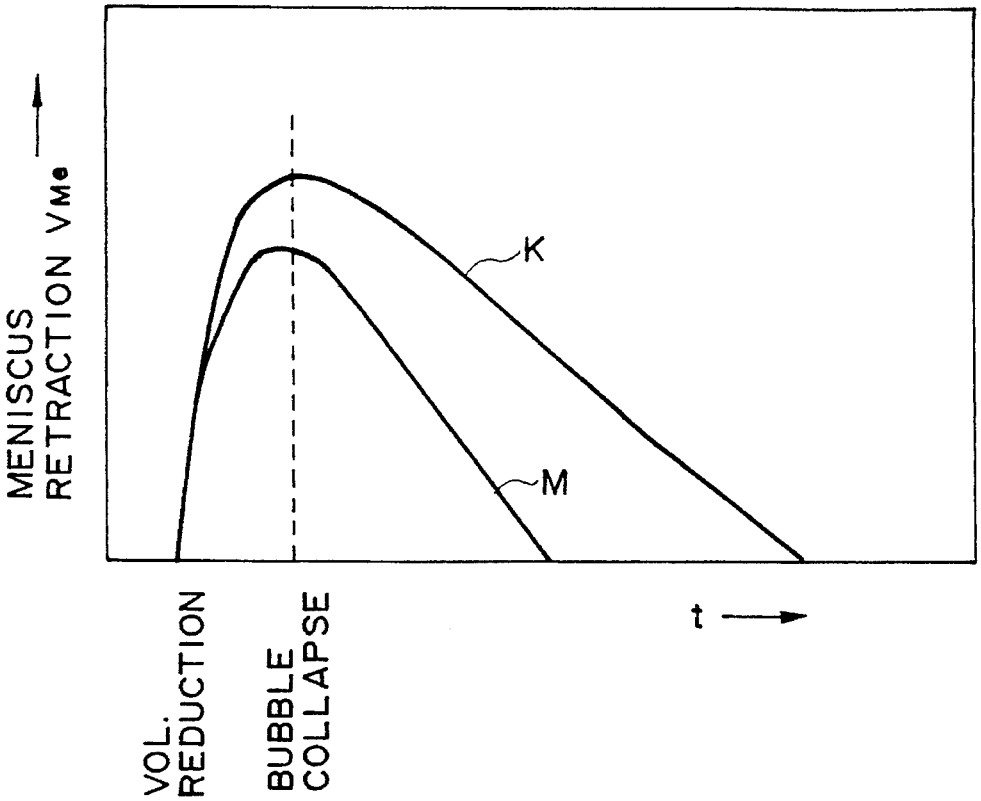
FIG. 5 is a graph showing a relationship between a meniscus retraction (distance) and time, corresponding to FIG. 4.

FIG. 5 shows the above-described relationships. As will be understood from this Figure, the meniscus retraction is small in the M region, and in addition, the refilling speed is high. In the K region, however, the meniscus retraction is large, and the refilling speed is low. Therefore, the recording head falls in K region, the blurred print occurs.

Figure 6:
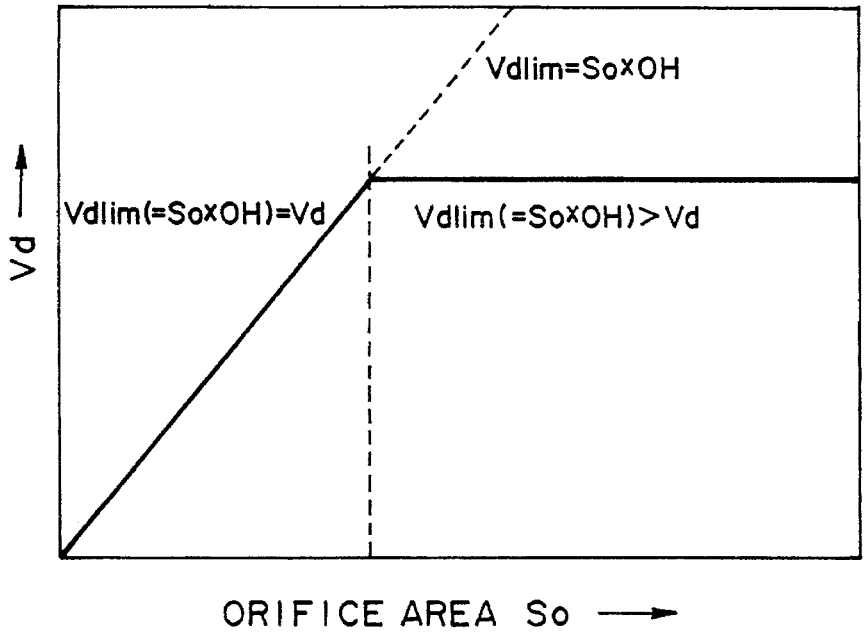
FIG. 6 is a graph showing a relationship between an orifice area $S_0$ and a volume of ink droplet ejected Vd.

FIG. 6 shows a relationship between an orifice area $S_0$ and an ejection volume Vd. If $S_0$>OH≦ Vd, Vd is not influenced by the orifice area $S_0$ due to the manufacturing tolerances. This is the condition for preventing the blurred print.

The description will be made as to the case in which the ink container has strong capillary force as in the case of an ink absorbing material contained in the ink container. A typical example of this is seen in an ink jet head cartridge having integral recording head and ink container.

Figure 14:
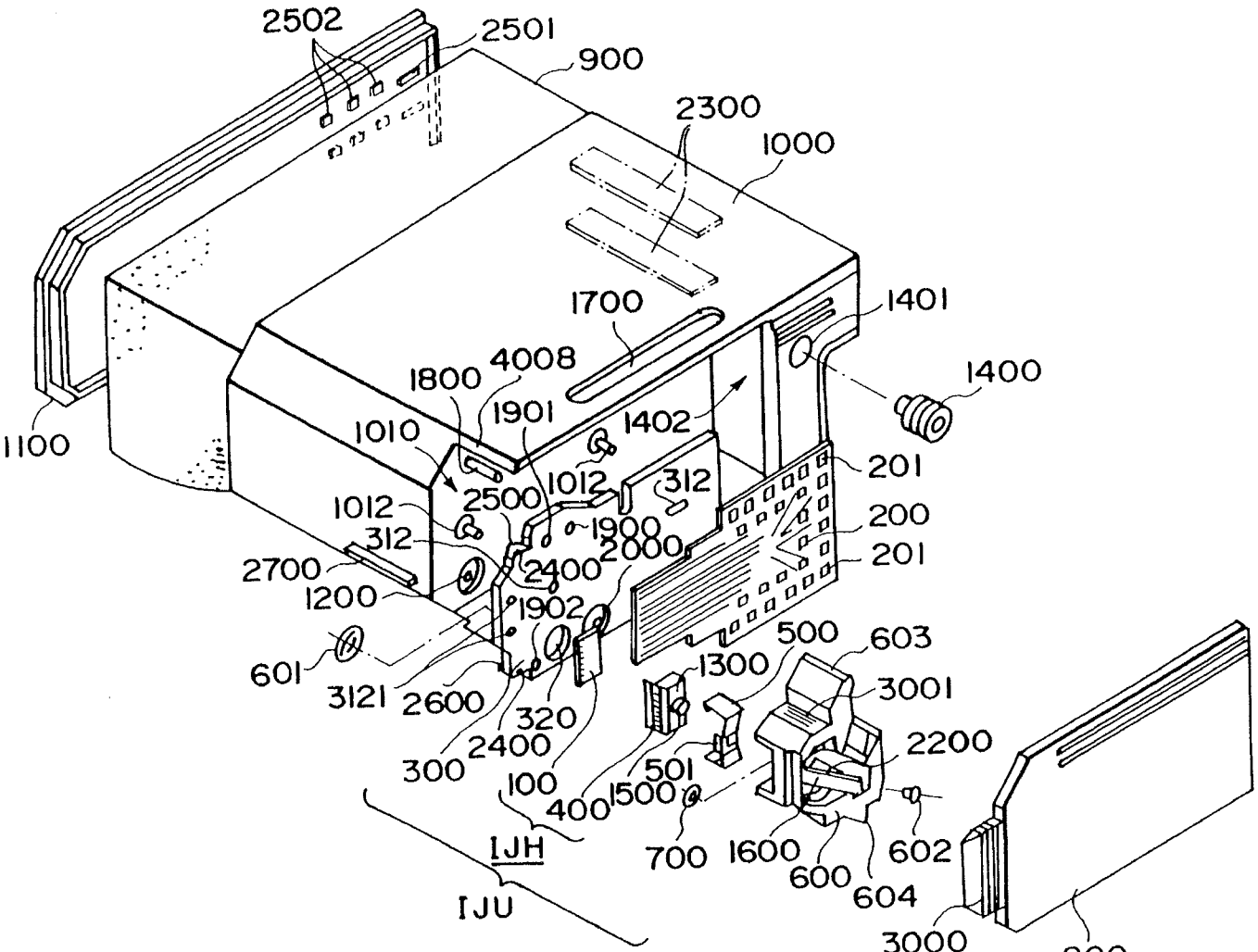
FIG. 14 is an exploded perspective view of an ink jet cartridge having an integral recording head and ink container.

FIG. 14 is an exploded perspective view of an exemplary ink jet head cartridge. As shown in this Figure, the recording head unit IJU is of a type in which thermal energy is generated in response to an electric signal to cause film boiling in the ink to eject the ink. The heater board 100 is provided with electrothermal transducers (ejection heaters) for generating the thermal energy, arranged on lines on a Si substrate, and electric wiring of Al or the like for supplying the electric power thereto. They are formed through a film forming process. The wiring board 200 comprises lines corresponding to the wiring of the heater board (to be connected through wire bonding process or the like), and pads 201 for receiving electric signals from the main assembly, the pads 201 being located at the end portion of the wiring. A top plate 1300 is provided with partition walls for constituting ink passages corresponding to the plurality of ink ejection outlets and for constituting a common liquid chamber or the like. It also comprises an ink receiving port 1500 for introducing the ink into the common liquid chamber from an ink container, and an integral orifice plate 400 having a plurality of ejection outlets. The partition walls or the like of the top plate 1300 is integrally formed with the top plate 1300, and the integral molding material is preferably polysulfone, but another proper molding resin material is usable.

A supporting member 300 supports on a plane the backside of the wiring board 200, and is made of metal or the like to function as a structural member of the recording head unit. The confining spring 500 is in the form of "M". The central portion of M-shape urges the top plate 1300 at the portion corresponding to the common liquid chamber, and an apron 501 thereof urges by a line pressure at a position corresponding to the ink passage of the top plate 1300. The legs of the confining spring 500 are engaged with the bottom surface of the supporting member 300 through holes 3121 of the supporting material 300 to sandwich the heater board and the top plate 1300 between itself and the supporting member 300, by which the heater board 100 and the top plate 1300 are securely pressed and fixed to the supporting member 300 by the urging force of the confining spring 500 and the apron 501. The supporting material 300 is provided with two positioning holes 312 engageable with two positioning projections 1012 of the ink container and two positioning holes 1900 engageable with two positioning and heat fusing fixing projections 1800. It is also provided at the rear side with positioning projections 2500 and 2600, corresponding to the carriage of the main assembly. In addition, the supporting member 300 also comprises a hole 320 for permitting penetration of the ink supply pipe 2200, which will be described hereinafter, to permit the ink supply from the ink container. The mounting of the wiring board 200 relative to the supporting member 300 is accomplished by bonding with bonding material or the like.

Figure 15:
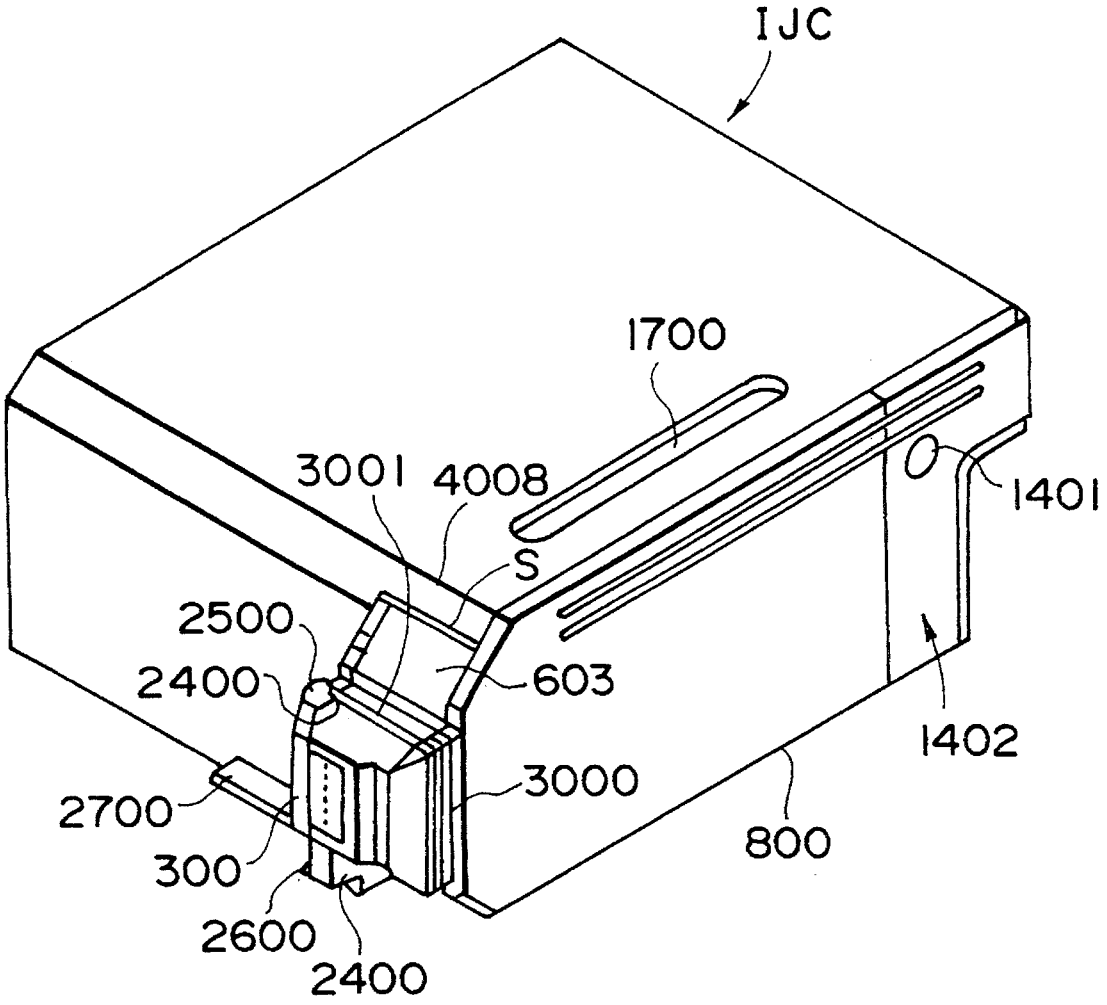
FIG. 15 is a schematic perspective view of an ink jet head cartridge according to an embodiment of the present invention.

Recesses 2400 and 2400 of the supporting member 300 are provided adjacent positioning projections 2500 and 2600, and the recesses are on extensions of a plurality of parallel grooves 3000 and 3001 on three sides around the recording head unit IJU when the head cartridge is assembled, as shown in FIG. 15, so that the foreign matter, the ink or the like does not reach the projections 2500 and 2600. A covering member 800 having the groove 3000 constitutes an outer wall of a heat cartridge, and simultaneously constitutes a part accommodating the recording head unit IJU. An ink supply member 600 having the parallel groove 3001 is connected with the above-described ink supply tube 2200, by which the ink conduit 1600 communicating with the ink is supported in the form of a fixed cantilever at the connecting side with the supply pipe 2200. The ink supply tube 2200 is provided with a sealing pin 602 to assure the capillary action relative to the ink supply tube 2200 at a fixing position of the ink conduit 1600. Designated by a reference numeral 601 is a gasket for sealing between the ink container and the supply tube 2200, and 700 is a filter provided at an ink side end of the supply tube 2200. The ink supply member 600 is molded, and therefore, the positional accuracy is high with low cost. The cantilever type conduit 1600 permits the stabilized press contact of the conduit 1600 to the ink supply port 1500 of the top plate 1300, even if it is mass-produced. In this embodiment, a sealing and bonding material is supplied from ink supply passage while the pressure contact is established.

For the purpose of the ink supply passage member 600 onto a supporting member 300, backside pins (not shown) of the ink supply passage member 600 for engaging into the holes 1901 and 1902 of the supporting member 300, are inserted to these holes, and the portions projected out of the backside are heat-fused. Thus, the fixing is easy. The slightly projected portions which have been heat-fused, are in unshown recesses in the mounting side of the ink container relative to the recording head unit IJU, therefore, the positioning of the unit IJU is accurate.

The ink container comprises a cartridge main body 1000, an ink absorbing material 900, and a cover 1100 for covering the cartridge main body after the ink absorbing material 900 is inserted into the main body 1000 through a side opposite from the unit IJU mounting side. The absorbing material 900 is disposed in the cartridge main body 1000. The supply port 1200 functions to supply the ink to the ink jet unit IJU comprising the above-described elements 100–600. Before the unit is mounted to a portion 1010 of the cartridge main body 1000, the ink is injected through the supply port 1200, so that the ink absorbing material 900 absorbs the ink. In this embodiment, the ink can be injected through an air vent 1401 and the supply port. However, an air existing region formed by ribs 2300 on the inside surface of the main body 1000 and the ribs 2501 and 2502 on the inside surface of the cover 1100, is disposed at a portion continuing from the air vent 1401 side, and the ink supply port 1200 is disposed at a corner region most distant from the ink supply port 1200, by which the ink supply property from the ink absorbing material is maintained in order. Therefore, the ink injection into the absorbing material, which is good and uniform, is preferably effected through a supply port 1200. This is practically very effective. The rib 2300 comprises four (only two are shown in FIG. 14 at the top surface) parallel with the carriage movement direction, behind the cartridge main assembly 1000. This is effective to prevent the close contact of the absorbing material to the main assembly 1000. In addition, partial ribs 2501 and 2502, are on an extension of the rib 2300, and are provided on the inside surface of the cover 1100. However, it is divided as is different from the case of the rib 2300. By doing so, the air existing space is increased. Ribs 2501 and 2502 are distributed to be dispersed in less than one half of the entire area of the cover 1100. By these ribs, the ink in a region adjacent the corner most remote from the container supply port 1200, in the ink absorbing material 900, can be stably and assuredly introduced to the supply port 1200 by the capillary force. Designated by 1401 is an air vent formed in the covering member to introduce the ambient air into the ink container. A water repelling material 1400 is disposed at the inside of the air vent 1401. By this, the ink leakage from the air vent 1400 can be prevented. The ink accommodating space of the ink container is rectangular parallelepiped, and the long side is at the side surface, and therefore, the above-described rib arrangement is particularly effective. In the case of the long side being parallel with the carriage movement direction, or in the case of the shape of the accommodating space being a cube, the ribs are arranged on the entirety of the cover 1100, so that the ink supply from the ink absorbing material 900 is stabilized.

The unit IJU is enclosed except for the bottom opening, by the ink container and the cover 800 covering the unit IJU after the mounting of the unit IJU. The head cartridge is mounted on the carriage on the main assembly. At this time, the bottom opening is close to the carriage, and therefore, a substantially 4-side-enclosed space is provided. Therefore, the heat generated from the recording head IJH in the enclosed space, is uniformly dispersed in the space, thus maintaining a constant temperature of the space. However, a small temperature rise may occur, for example, when the head IJH is continuously driven for a long period of time. For this reason, in this embodiment, in order to assist the spontaneous head radiation from the supporting member 300, a small width slit 1700 (smaller than the space) is provided in the upper surface of the cartridge, thus preventing the temperature rise, without influence to the temperature distribution uniformity function of the entire unit IJU being influenced by the ambience.

When the head cartridge IJC is assembled, as shown in FIG. 15, the ink is supplied to the conduit 1600 in the ink supply passage member 600 from the supply port 1200 of the container through the supply tube 2200 disposed through the introduction port formed in the inside back surface of the supply container 600 and through the hole 320 of the supporting member 300. After passing through the inside thereof, the ink is fed to the common liquid chamber through the ink introduction port 1500 formed in the top plate 1300. At the connecting portion between the supply pipe and the conduit, a gasket of silicone rubber or butyl rubber or the like is disposed to assure the ink supply passage by the sealing effect thereof.

In this embodiment, the top plate 1300 is made of resin material exhibiting high ink resistance property, such as polysulfone, polyethersulfone, polyphenylene oxide, polypropylene or the like. It is simultaneously molded integrally with the orifice plate 400, by a metal mold.

In such an ink jet recording head, as described hereinbefore, a high vacuum is applied at the time of the start of ejection, and therefore, the retraction volume of the meniscus is follows:

$$\begin{aligned} V'Me &= (R'+P)/(F'+R'+P)\times Vb \\ &= (R'+P)/(F'+R'+P)\times(F+R)/R\times Vd \end{aligned} \quad (7)$$

where P ($m^{-1}$) is a flow resistance of the ink container. The flow resistence P is determined in the same dimension as F and P, on the basis of the negative pressure measured at the common chamger as $$P=\delta p\times Sr/(Q\times y)$$

where δp (pa) is a negative pressure in the container produced (X3 in FIG. 7), Sr ($m^2$) is area at upstream ends of the nozzles, Q is flow rate ($m^3$/sec), and y (pa.sec) is viscosity of the ink.

As will be understood from the above equation, the meniscus is retracted more than in the case where the ink container does not have high capillary force.

Figure 9:
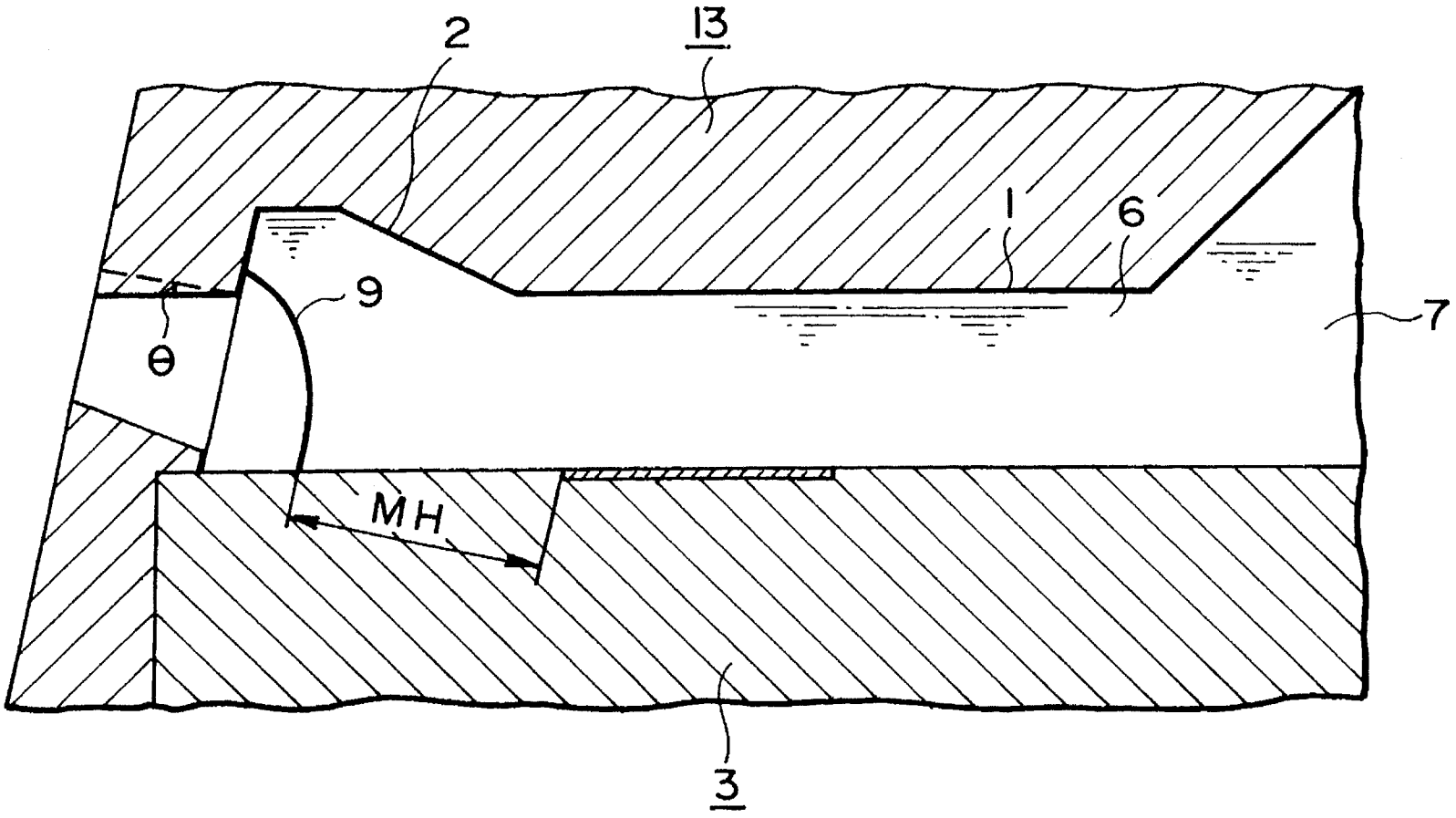
FIG. 9 is a cross-sectional view of an ink passage showing a distance between an ink meniscus and a heater, in the embodiment of the present invention.
Figure 10A:
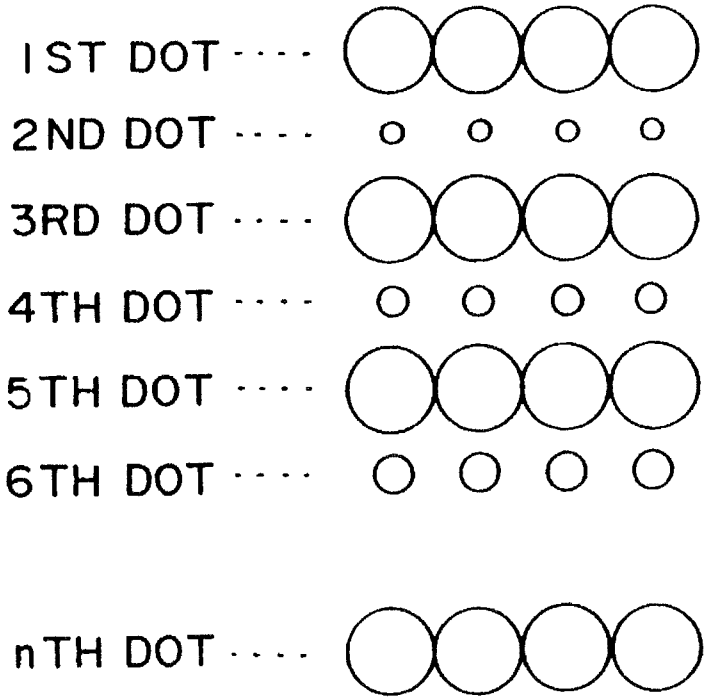
FIGS. 10(A) and 10(B) are schematic views of results of recording according to this embodiment and prior art.

Particularly in the case of the second and subsequent several ejections among the continuing ejections, the refilling action is so slow that the bubble creation starts before the meniscus 11 returns to the orifice 5. For this reason, when the meniscus-heater distance MH ($\times S_0$) in FIG. 9 is smaller than the ink droplet volume (Vd), the volume of the droplet going to be ejected subsequently reduces, and therefore, the odd number dots in FIG. 10(A) are recorded. As for the dots subsequent to these small dots, the dots having the same size as the first dot is recorded. These are repeated. As a result, the odd number dots have the same size as the first dot size, and the even number dots have small sizes. With the gradual decrease of the vacuum, the dot size increases until the n-th has the same size as the first dot (normal vacuum).

In this embodiment, the MH distance upon the start of the bubble creation for the second dot, satisfies:

$$MH\times S_0>V_{d1} \quad (8)$$

Figure 10B:
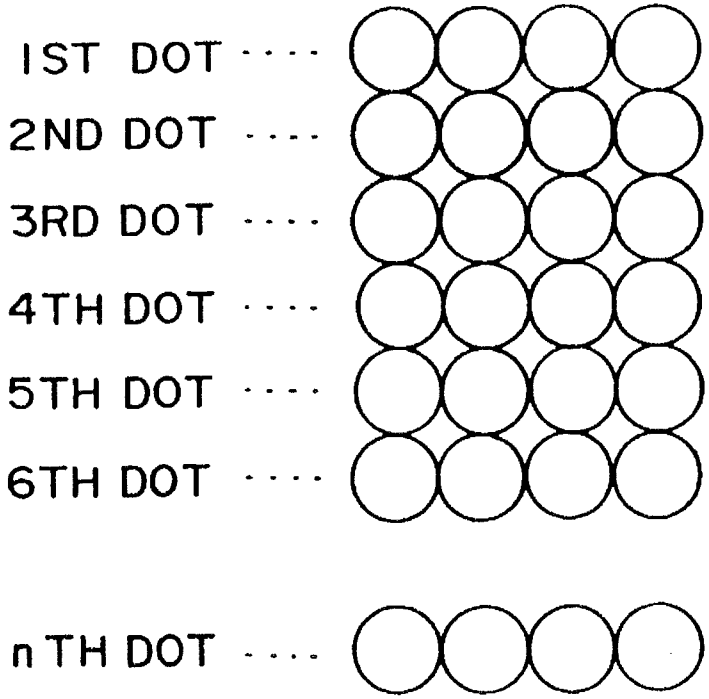

As a result, as shown in FIG. 10(B), the size of the recorded dots is maintained constant.

If the equation (8) is noted particularly in the volume of the ink passage in front of the heater, $$V_{OH}>V'Me+Vd \quad (9)$$

where $V_{OH}$ is a volume of the ink passages in front of the heater edge adjacent the orifice. Thus, the blurred print or the dot size reduction attributable to the sudden retraction of the meniscus upon the start of the ejection, can be prevented. Thereafter, the vacuum reaches the normal state, and therefore, the printing operation is stabilized.

By combining equation (7) and equation (9), the following equation results:

$$V_{OH}>[(R'+P)/(F'+R'+P)\times(F+R)/R+1]Vd \quad (10)$$

As for the method of determining the ejected ink volume, there are the following methods. Five sheets are subjected to the printing operation for 1500 same characters, the size of the recording sheet being A4. The weight difference of the head cartridge (device) between before and after the printing, is determined. The result is divided by the total number of dots, so that the weight of 1 dot is determined. The volume is calculated using the specific gravity of the ink. During the measurement, the recovery or refreshing operation is not carried out.

As described hereinbefore, the flow resistance can be calculated by (length)/(cross-sectional area). If the cross-sectional area of the ink passage is not constant as in this embodiment, the cross-sectional area can be integrated to calculate the average cross-sectional area. Furthermore, although the flow resistance should be calculated for the ink passage, the liquid chamber and the supply passage, the flow resistance of the liquid chamber and the supply passage may be neglected, since the cross-sectional areas of the liquid chamber and the supply passage, are quite large as compared with the cross-sectional area of the ink passage. The flow resistance F' downstream of the bubble and the flow resistance R' upstream of the bubble, may be:

F1=(the distance between the orifice and the edge of the heater near the orifice)/(cross-sectional area of the ink); and R'=(the distance between the ink passage edge adjacent the liquid chamber and the edge of the heater adjacent the liquid chamber)/(cross-sectional area of the ink passage).

The vacuum may be measured by mounting a fine tube to the ink supply port of the ink container or to the ejection port of the recording head.

When the upper limit of the driving frequency is determined, the blurred print can be prevented by the following ink passage.

The upper limit of the drive frequency is $f_{lim}$, and the time required for the meniscus to return the position before the ejection is $t_m$, then the number of dots corresponding to the time required for the meniscus to restore to the position before the ejection is:

$$Dm=f_{lim}\times t_m \quad (11)$$

The blurness of the print can be avoided if the volume ($V_{OH}$) of the ink passage in front of the heater is larger than the volume of the ink ejected before the meniscus returns to the static position before the ejection. This condition is expressed by:

$$V_{OH}>Dm\times Vd=f_{lim}\times t_m\times Vd1 \quad (12)$$

where Vd1 is the ejection volume of the ink of the first dot.

The time $t_m$ is determined by the impedances and reactances of the recording head and the ink container, and is normally 5–30 μsec.

When $V_{OH}$ is determined, the condition determined by (12) can be used for selecting the maximum driving frequency at which the stabilized ejection is possible.

Figure 11:
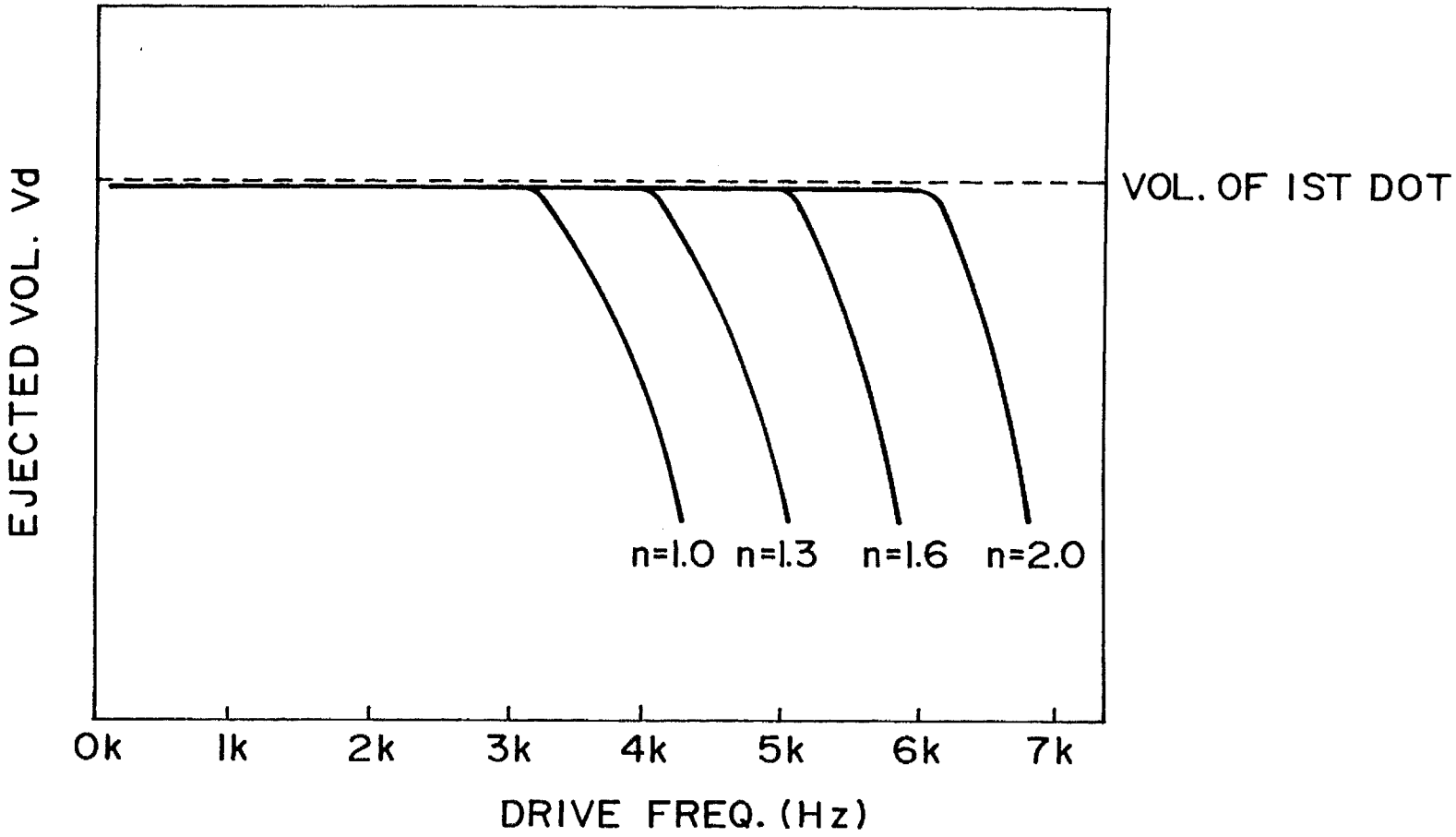
FIG. 11 is a graph showing a relationship between a drive frequency and ejected volume with a parameter n relating to the driving frequency.

If it is assumed that (the ink volume between the heater front edge and the orifice)>n×(the volume of the first ejected ink), is the condition to satisfy equation (8), n in the recording head shown in FIG. 1 has the property shown in FIG. 11 in accordance with the driving frequency of the recording head.

In other words, in order to stably eject the constant volume, the following is preferably satisfied.

$$n=1/3000\times f_{OP} \quad (13)$$

Figure 7:
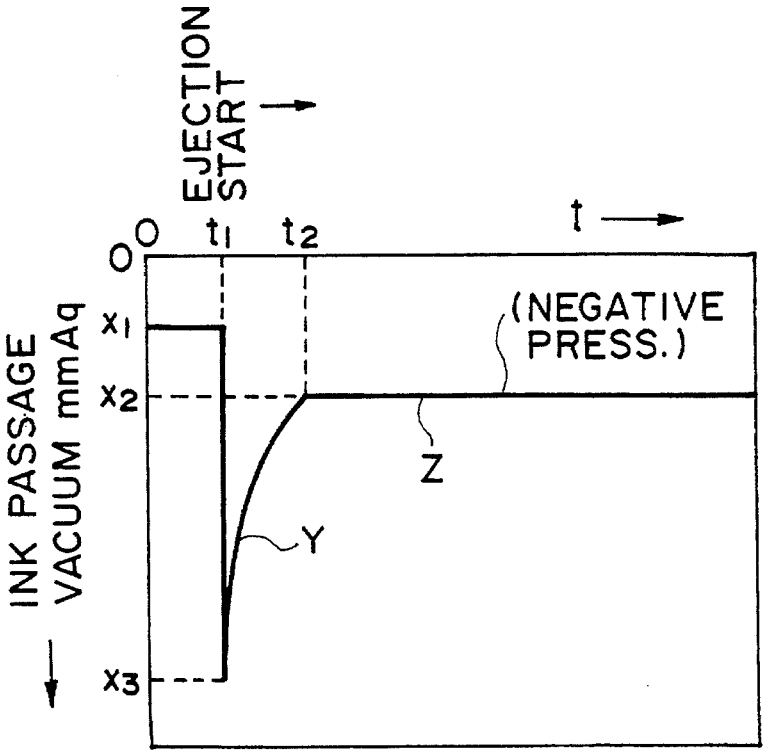
FIG. 7 is a graph showing a vacuum produced in the ink passage of the recording head, with time.
Figure 8:
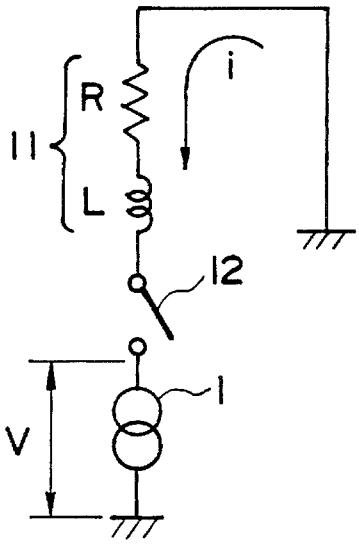
FIG. 8 is a circuit diagram of an equivalent circuit to an ink supply system and an ink passage of a recording head to explain the production of the vacuum.
Figures 12A, 12B, 12C:
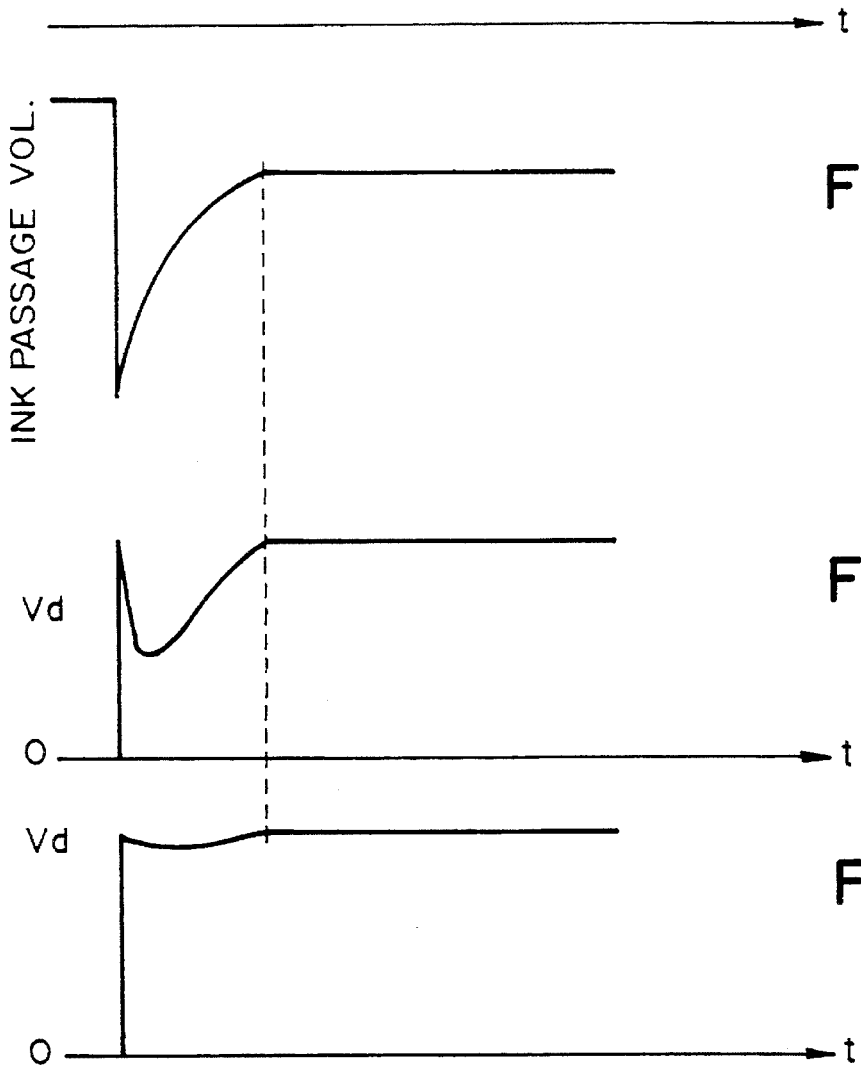
FIGS. 12(A)–12(C) are graphs showing changes of the vacuum in the ink passage, the change of the ejected volume in the prior art and that in this embodiment.

FIG. 12 shows the comparison of the change of the ejected volume with time between the prior art example and this embodiment. FIG. 12(A) shows the vacuum change shown in FIG. 7, and FIG. 12(B), shows the ejected volume change in the conventional ink passage structure, and FIG. 12(C) shows the ejected volume change in this embodiment. As will be understood from FIG. 12(C), the reduction of the ejected volume at the time of the ejection start can be minimized. According to this invention, the blurness of the print due to the reduction of the ejection volume, occurring in the conventional ink passage structure, can be prevented, and therefore, the ejection can be stabilized even at the start of the ejection.

EMBODIMENT 1

The recording head has the structure shown in FIG. 1. The ink passage length from the orifice to the liquid chamber is 485 μm. The center of the heater is located at 247 μm away from the orifice of the ink passage. The heater has a length of 105 μm and a width of 40 μm.

The average cross-sectional area of the ink passage in the front part beyond the center of the heater is 2300 $\mu m^2$, and the average cross-sectional area behind the center is 2000 $\mu m^2$. The average cross-sectional area in front of the front edge of the heater is 2400 $\mu m^2$, and the average cross-sectional area behind the rear edge of the heater is 2000 $\mu m^2$. The volume of the ejected ink is 80 pl. The ink container is provided with an ink absorbing material, and the flow resistance thereof is $0.173\times10^{+6}$ $m^{-1}$ and the volume of the ink passage from the front edge of the heater to the orifice is $400\times10^{-15}$ $m^3$. Such a recording head was driven at the driving frequency of 3.5 kHz. No blurness of print is observed.

COMPARISON EXAMPLE 1

A recording head which was the same as in Embodiment 1 except for the center of the heater is located at 90 μm from the orifice, was manufactured. The average cross-sectional area in front of the center of the heater in the ink passage is 2500 $\mu m^2$, and the average cross-sectional area behind it is 2020 $\mu m^2$. The average cross-sectional area in front of the front edge of the heater is 2800 $\mu m^2$, and the average cross-sectional area behind the rear edge of the heater is 2000 $\mu m^2$. The volume of the ink passage from the front edge of the heater to the orifice is $120\times10^{-15}$ $m^3$.

Such a recording head has driven at the driving frequency of 3.5 kHz. The print was blurred around the start of the ejection.

Figure 13:
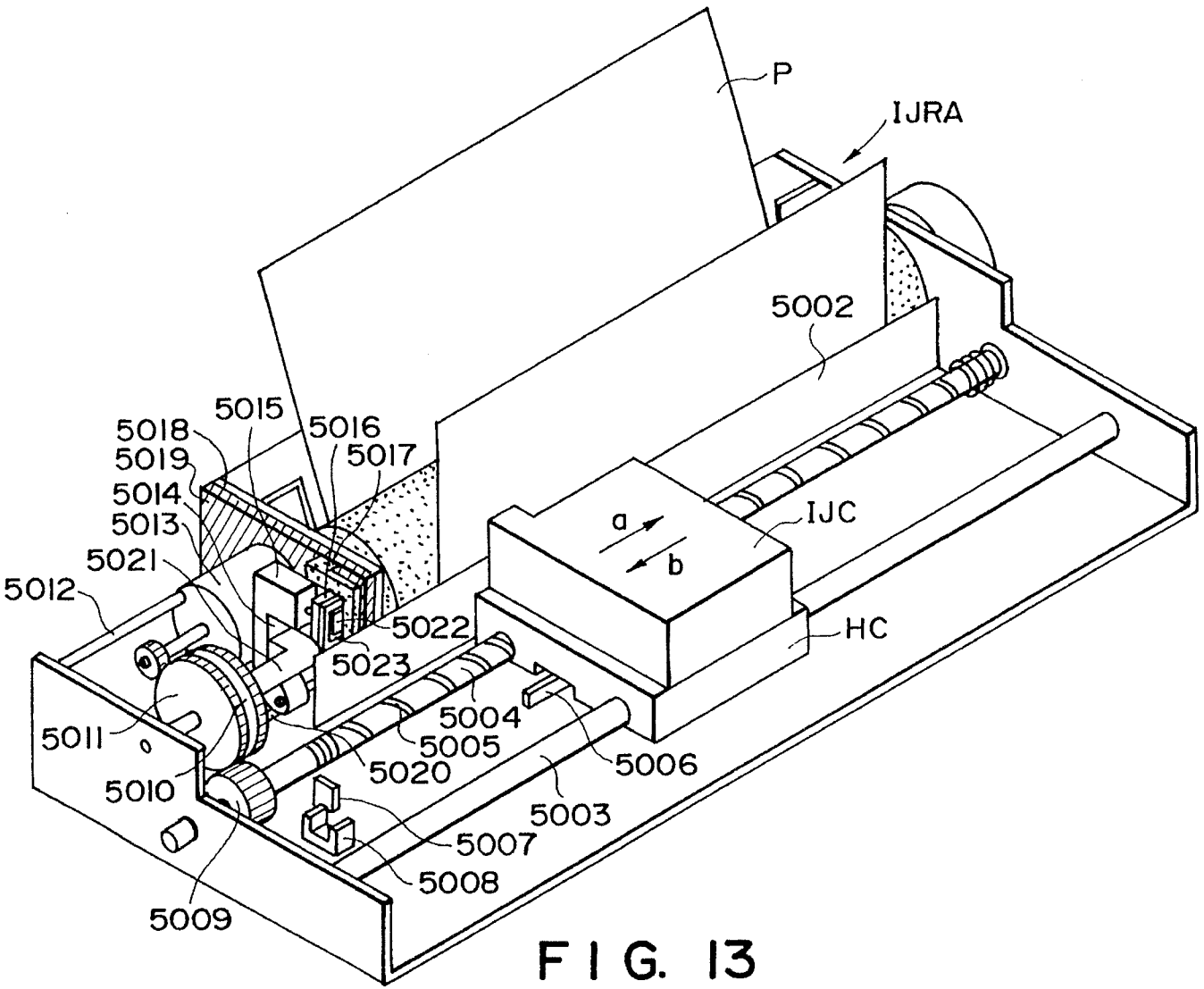
FIG. 13 is a perspective view of an ink jet recording apparatus capable of using the recording head according to this invention.

FIG. 13 shows a general arrangement of an ink jet recording apparatus IJRA using an ink jet recording head cartridge. The ink jet cartridge IJC has an integral recording head and an ink container, and is carried on a carriage HC. The carriage HC is engaged with a helical groove 5005 of a lead screw 5004 which rotates in accordance with forward and backward rotation of a driving motor 5013 through a drive transmission gear 5011 and 5009. To establish this engagement, the carriage HC is provided with a pin (not shown). By this, the carriage is reciprocated in the directions indicated by a and b. To the carriage HC, the recording head portion 5025 and the ink container portion 5026 are mounted. A sheet confining plate 5002 is effective to urge the sheet to the platen 5000 over a movement range of the carriage. Elements 5007 and 5008 constitute a photocoupler which detects the presence of a lever 5006 of the carriage to effect switching of the rotational direction of the motor 5013 or the like. Thus, the photocoupler functions as a home position-detecting means. Designated by reference numeral 5016 is a member for supporting the capping member 5022 for capping the front side of the recording head, and 5015 is suction means for suctioning the inside of the cap. It effects suction recovery operation for the recording head through an opening 5023 in the cap. A cleaning blade 5017 is movable to and fro by a member 5019. They are supported on a supporting frame 5018. As for the blade, any known cleaning blade is usable. A lever 5021 is used to start the suction operation, and is moved in accordance with the movement of a cam 5020 engageable with the carriage. The driving force from the driving motor is controlled through known transmitting means such as clutch mechanism or the like.

The capping, cleaning and suction recovery operations are carried out at the proper positions by the operation of the lead screw 5004 when the carriage HC is adjacent the home position. Other known structures are usable if the operations are effected at the proper timing.

In the foregoing, the description has been made as to the ink jet recording apparatus using an ink jet cartridge. However, the present invention is applicable to an ink jet recording apparatus to which the ink is supplied from an ink container to the recording head through very fine pipes.

Heretofore, it has been deemed that in order to enhance the ejection efficiency and enhance the responsive frequency with stabilized ink droplet ejection, the ejection heater is as close as possible to the ejection outlet. This is correct in a sense, but the following has been found as a result of complicated structure of the ink supply passage and the ink passage structure and the investigation of the ink passage.

First, the volume Vd of the ink droplet ejected from the ejection outlet (this is determined by collecting several tens—several droplets and obtaining an average) changes in the manner not predicted, in response to the change of the minimum distance OH from the ejection outlet to the ejection heater. More particularly, in the relation between the minimum distance OH and the volume Vd of the ejected ink droplet, the volume Vd decreases with the increase of the distance OH in the range of the distance OH exceeding the distance $OH_1$ providing the maximum ejection volume Vdmax; and the volume Vd decreases with decrease of the distance OH in the range of the distance OH smaller than the distance $OH_1$. In this invention, the recording head has the structure in which the distance OH exceeds the distance $OH_1$ providing Vdmax. In this case, if a larger ejection volume is desired, the distance OH is made closer to the distance $OH_1$.

In the case of the distance OH which provides the ink droplet smaller than Vdmax and smaller than the distance $OH_1$, the instability of the ink droplet is significant. In the distance range of the above first invention, the instability of the ink droplet is removed, in other words, uniform droplet formation is possible.

As a second aspect of the invention which may be used alone or may be combined with the above first aspect, the inside volume V of the ink passage downstream of the front edge of the heater surface (the volume of the ink retained by the capillary force under the normal state of the meniscus) is not less than $\{\frac{1}{3}\times f(kHz)+n\}\times Vd$. Here, f is the maximum driving frequency, n is number of problems of indefinite conditions of the liquid or solid ink to be supplied to the recording head and the problems of the recording head itself (the structure of the recording head producing crosstalk, for example, supply instability of the absorbing material in the ink container, for example), wherein if there are m problems, n=m. This is considered as a safety factor in which 1 corresponds to one problem. In this above formula Vd is the ink droplet volume to be ejected if all of the ejection instability problems are solved in a certain recording head, n=0 in the recording head. By satisfying this condition, the ink droplet can be continuously ejected with highly uniform state for a desired frequency.

The present invention is usable with any ink jet apparatus, such as those using an electromechanical converter such as piezoelectric element, but is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals.

By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure waves of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head or plural recording heads combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or suction means, preliminary heating means which may be the electrothermal transducer, an additional heating element or a combination thereof. Also, means for effecting preliminary ejection (not for the recording operation) can stabilize the recording operation, As regards the variation of the recording head mountable, it may be a single head corresponding to a single color ink, or may be plural heads corresponding to the plurality of ink materials having different recording colors or densities. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30 ° C. and not higher than 70° C. to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left unused, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

While the invention has been described with reference to the structures disclosed herein, it not confined to the details set forth and this application is intended to cover such modifications or changes as may come within the purposes of the improvements or the scope of the following claims.

What is claimed is:

1. An ink jet recording apparatus comprising:

an orifice for ejecting ink;

a heater for generating thermal energy to produce a bubble to eject the ink;

an ink passage for supplying ink to said orifice, said ink passage being provided with said heater;

an ink container for containing ink to be supplied to said ink passage, said ink container retaining the ink, using capillary force;

wherein the following is satisfied:

$$V_{OH}>[(R'+P)/(F'+R'+P)\times(F+R)/R+1]Vd$$

where $V_{OH}$ is a volume of the ink passage from said orifice to an edge of said heater adjacent said orifice; Vd is a volume of from said orifice ejected ink; F is a flow resistance from a center of said heater to said orifice; R is a flow resistance from a center of said heater to said ink container; F' is a flow resistance from a maximum bubble produced on said heater to said orifice; R' is a flow resistance from a maximum bubble produced on said heater to said ink container; and P is a flow resistance of said ink container.

2. An ink jet cartridge comprising:

an orifice for ejecting ink;

a heater for generating thermal energy to produce a bubble to eject the ink;

an ink passage for supplying ink to said orifice, said ink passage being provided with said heater;

an ink container for containing ink to be supplied to said ink passage, said ink container retaining the ink, using capillary force;

wherein the following is satisfied:

$$V_{OH}>[(R'+P)/(F'+R'+P)\times(F+R)/R+1]Vd$$

where $V_{OH}$ is a volume of the ink passage from said orifice to an edge of said heater adjacent said orifice; Vd is a volume of from said orifice ejected ink; F is a flow resistance from a center of said heater to said orifice; R is a flow resistance from a center of said heater to said ink container; F' is a flow resistance from a maximum bubble produced on said heater to said orifice; R' is a flow resistance from a maximum bubble produced on said heater to said ink container; and P is a flow resistance of said ink container.

* * * * *

UNITED STATES PATENT AND TRADEMARK OFFICE

CERTIFICATE OF CORRECTION

PATENT NO. : 5,485,186 Page 1 of 4

DATED : January 16, 1996

INVENTOR(S) : Hiroyuki ISHINAGA, et al.

It is certified that error appears in the above-indentified patent and that said Letters Patent is hereby corrected as shown below:

COLUMN 1:

Line 10, "is" should be deleted;
Line 13, "Wherein" should read --wherein--;
Line 21, "a" should read --an--;
Line 41, "resistance-element" should read --resistance element--;
Line 61, "90 μn" should read --90 μm--;
Line 64, "the" should read --of the--.

COLUMN 2:

Line 22, "blurrness" should read --blurriness--;
Line 46, "blurrness" should read --blurriness--.

COLUMN 4:

Line 4, "blurrness" should read --blurriness--;

UNITED STATES PATENT AND TRADEMARK OFFICE

CERTIFICATE OF CORRECTION

DATED : January 16, 1996

INVENTOR(S) : Hiroyuki ISHINAGA, et al.

It is certified that error appears in the above-indentified patent and that said Letters Patent is hereby corrected as shown below:

Line 36, "blurrness" should read --blurriness--;

Line 37, "blurrness" should read --blurriness--.

COLUMN 5:

Line 42, "FIG. 4(C)" should read --FIGS. 4(C)--;

Line 46, "FIG. 4(C)" should read --FIGS. 4(C)--;

Line 67, "tile" should read --the--.

COLUMN 6:

Line 15, "$S_0$>OH≦ Vd," should read --$S_0$ x OH > Vd,--.

COLUMN 9:

Line 2, "is" should read --is as--;

Line 9, "chamger" should read --chamber--.

UNITED STATES PATENT AND TRADEMARK OFFICE

CERTIFICATE OF CORRECTION

PATENT NO. : 5,485,186 Page 3 of 4

DATED : January 16, 1996

INVENTOR(S) : Hiroyuki ISHINAGA, et al.

It is certified that error appears in the above-indentified patent and that said Letters Patent is hereby corrected as shown below:

COLUMN 10:

Line 8, "passage," should read --passage--;
Line 12, "F1=(the" should read --F'=(the--.

COLUMN 11:

Line 34, "has" should read --was--;
Line 59, "suction" should read --the suction--.

COLUMN 13:

Line 16, "the the" should read --the--.

COLUMN 14:

Line 17, "is the" should read --is applied. The--;
Line 43, "it" should read --it is--;
Line 64, "of" should read --of ink ejected-- and "orifice ejected ink;" should read --orifice;--;

UNITED STATES PATENT AND TRADEMARK OFFICE

CERTIFICATE OF CORRECTION

PATENT NO. : 5,485,186 Page 4 of 4

DATED : January 16, 1996

INVENTOR(S) : Hiroyuki ISHINAGA, et al.

It is certified that error appears in the above-indentified patent and that said Letters Patent is hereby corrected as shown below:

Line 66, "said ink" should read --said orifice; R is a flow resistance from a center of said heater to said ink--.

COLUMN 16:

Line 5, "of" should read --of ink ejected-- and "orifice ejected ink;" should read --orifice;--.

Signed and Sealed this

Sixteenth Day of July, 1996

Bruce Lehman

*Attest:*

BRUCE LEHMAN

*Attesting Officer*

*Commissioner of Patents and Trademarks*